US005345427A

United States Patent [19]

Ishida et al.

[11] Patent Number: 5,345,427

[45] Date of Patent: Sep. 6, 1994

[54] ULTRASONIC TRANSDUCER

[75] Inventors: Yoshihiko Ishida, Nagoya; Yuji Asai, Chita; Makoto Tani, Inazawa, all of Japan

[73] Assignee: NGK Insulators, Ltd., Japan

[21] Appl. No.: 37,457

[22] Filed: Mar. 26, 1993

[30] Foreign Application Priority Data

Mar. 31, 1992 [GB] United Kingdom ..... 9206943.4

[51] Int. Cl.[5] ..... H04R 17/00

[52] U.S. Cl. ..... 367/140; 367/157; 310/322; 381/150; 381/190

[58] Field of Search ..... 367/140, 157, 149, 178, 367/180; 310/322, 334; 381/150, 168, 173, 190

[56] References Cited

U.S. PATENT DOCUMENTS

| | | | |
|---|---|---|---|
| 3,240,962 | 3/1966 | White | 310/8 |
| 3,671,193 | 6/1972 | Jaskolski et al. | 23/148 |
| 5,220,893 | 6/1993 | Kibblewhite | 73/761 |

FOREIGN PATENT DOCUMENTS

| | | |
|---|---|---|
| 2029091 | 3/1980 | United Kingdom . |
| 2157075 | 10/1985 | United Kingdom . |

OTHER PUBLICATIONS

Patent Abstracts of Japan, vol. 9, No. 253 (P-395) (1976) Oct. 11, 1985 & JP-A-60-104,223 (Toshiba KK) Jun. 8, 1985.

Database WPIL, Week 8407, Derwent Publications Ltd., London, GB; AN 84-040322 & JP-A-59,003,091 (Tokyo Shibaura Denki KK) Jan. 9, 1984.

Database WPIL, Week 9131, Derwent Publications Ltd., London, GB; NA 91-228528 & SU-A-1,606,541 (Crystallog Inst) Nov. 15, 1990.

E. D. Kolb et al., *The Hydrothermal Growth of Low Carrier Concentration ZnO at High Water and Hydrogen Pressures,* Mat. Res. Bull. vol. 2, pp. 1099-1106, 1967. Pergamon Press, Inc. Printed in the United States.

Joseph S. Heyman, *Phase Insensitive Acoustoelectric Transducer,* J. Acoust. Soc. Am., vol. 64, No. 1, Jul. 1978.

Patent Abstract of Japan vol. 9, No. 253 (P-395) (1976), for JP 60-104223.

JP 59-003091 (Derwent An 84-040322).

SU 1606541 (Derwent An 91-228528).

*Primary Examiner*—J. Woodrow Eldred

*Attorney, Agent, or Firm*—Parkhurst, Wendel & Rossi

[57] ABSTRACT

A phase-insensitive ultrasonic transducer has a zinc oxide single crystal as a piezoelectric semiconducting acoustoelectric element, providing high sensitivity and operable over a range of wavelengths of the ultrasonic waves. The electrical conductivity of said zinc oxide single crystal may be selected in the range $10^{-8}$ to $10^{-2}$ $\Omega^{-1}.cm^{-1}$. The single crystal can have an attenuation rate for ultrasonic waves of 10 MHz of at least 0.8 $cm^{-1}$.

20 Claims, 7 Drawing Sheets

ULTRASONIC TRANSDUCER

BACKGROUND OF THE INVENTION

1. Field of the Invention

This invention relates to ultrasonic transducers, to ultrasonic devices and to ultrasonic detection and measuring apparatus. The invention also relates to a method of converting ultrasonic energy into electrical signals and to methods of detection of ultrasonic waves.

2. Description of the Prior Art

Ultrasonic sensing transducers in use at the present time are piezoelectric elements which have phase sensitivity. Such elements convert the acoustic wave into an electrical signal, which is proportional to the average pressure or strain produced in the piezoelectric element. Consequently, since the output signal is proportional to average pressure, it is affected by phase shift and modulation of the ultrasonic waves. This leads to erroneous outputs. Such detectors therefore can be used accurately for unmodulated ultrasonic waves produced by test samples of simple shape, using either echo pulses or transmitted waves. However, it is increasingly desired to use ultrasonic testing in non-destructive evaluation of objects of more complex shape and also in biological and medical fields. Phase-sensitive transducers are inadequate, since they produce erroneous signals if two phase-shifted waves are present simultaneously or if the wave is modulated.

A proposal has been made for a phase-insensitive ultrasonic transducer, using cadmium sulphide as a semiconducting acoustoelectric transducer employing charge carriers which couple to the acoustic wave (U.S. Pat. No. 4,195,244 and a related article "Phase insensitive acoustoelectric transducer" Joseph F. Heyman, J. Acoust. Soc. Am. 64(1), July 1978). These references also discuss earlier articles, devoted to the theory of ultrasonic wave propagation and attenuation in piezoelectric semiconductors. Reference should be made to these prior art documents for further explanation of the acoustoelectric effect. These references specifically mention that CdS is known as a photoconductive transducer, employing photo-generated charge carriers. A major defect of an acoustoelectric transducer relying on the photoconductive effect is the requirement for a light source which is cumbersome and lacks sufficient reliability to provide an accurate output from the transducer. The light source is also a source of electrical noise. The references mentioned appear to suggest that a cadmium sulphide crystal can act as an ultrasonic transducer by absorption of the acoustic energy by the free charge carriers in the crystal, but this is stated to require careful annealing for a particular time and at a particular temperature, to provide the maximum acoustic attenuation at the operating frequency. Such a device has low sensitivity and is specific to a given wavelength.

Further prior art which forms background of the present invention is discussed below, following an explanation of the invention itself.

SUMMARY OF THE INVENTION

It is therefore an object of the present invention to provide an ultrasonic transducer which is phase-insensitive, does not rely upon photoconduction, has high sensitivity and can be used over a range of wavelengths.

The present inventors have found that a zinc oxide single crystal can act as an effective piezoelectric semiconducting acoustoelectric element, without photoconduction, i.e. by interaction of the ultrasonic wave with the charge carriers in the crystal. Furthermore, a zinc oxide crystal suitable for use as an ultrasonic transducer has higher attenuation and a wider conductivity range for a given level of attenuation than cadmium sulphide. The zinc oxide single crystal has adequate intrinsic conductivity to act as a piezoelectric semiconductor.

Although zinc oxide is known as a semiconductor, and its piezoelectric property has also been reported, it apparently has not previously been suggested that a zinc oxide single crystal is a useful converter of ultrasonic energy into electrical signals by use of the acoustoelectric effect. The present inventors have found that particularly favorable results can be obtained by selection of appropriate conductivity of the zinc oxide single crystal, by control of impurities and of lattice defects in the single crystal as well as use of dopants to provide an appropriate level of charge carriers.

It is to be noted that zinc oxide has been used in conventional piezoelectric ultrasonic transducers. For example GB-A-2157075 describes polycrystalline thin films of ZnO, typically of a thickness of 4 μm. JP-A-59-003091 discusses manufacture of single crystals of various compounds including ZnO, for use of piezoelectric elements, but data such as purity or conductivity of the ZnO, for example, is absent so that the suitability of such a crystal, if made, as an acoustoelectric element cannot be assessed. SU-A1606541 describes zinc oxide single crystals made by the hydrothermal method, with a specified lithium impurity concentration, and proposes treatment of such crystals by implantation of oxygen ions in order to obtain a high-resistance surface layer of thickness 0.5–80 μm and resistivity of $10^{11}\Omega$.cm. It is stated that such product may find application in "opto- and acousto-electronics" e.g. in wideband ultrasound transducers, but this cannot be a reference to the acoustoelectric effect since the high-resistance layers makes the crystal useless for practice of the acoustoelectric effect which depends upon conduction in the crystal.

According to the present invention in one aspect there is provided an ultrasonic device having a zinc oxide single crystal adapted and arranged as an acoustoelectric ultrasonic wave sensing element.

According to the invention in one aspect, there is provided an ultrasonic transducer having a zinc oxide single crystal adapted to act as an acoustoelectric element and a pair of electrodes attached to opposite faces of the zinc oxide single crystal.

Different wave frequency are commonly utilized in ultrasonic detecting, depending on the specimen to be examined. Ultrasonic pulse waves ranging between 50 to 100 KHz is commonly used for concrete, 0.1 to 1 MHz for resin materials such as tires, 0.4 to 1 MHz for cast iron, 1 to 5 MHz for living organisms, 1 to 10 MHz for iron and steel and 10 to 50 MHz for ceramics.

The electrical conductivity of the zinc oxide single crystal is preferably selected so as to give the maximum absorption coefficient depending on the ultrasonic wave frequency being emitted. For example, for an average frequency of 100 KHz, an electrical conductivity of $10^{-8}$ to $10^{-5}\ \Omega.cm^{-1}$, is preferably, while for 100 MHz, a range of $10^{-5}$ to $10^{-2}\ \Omega.cm^{-1}$ is preferable. Other ranges may be appropriate for other frequencies.

The zinc oxide single crystal may contain at least one dopant element acting as acceptor or donor. It preferably contains not more than 2 ppm of impurities, apart from any dopant elements present.

Preferably, the zinc oxide single crystal has a charge carrier mobility of more than 8 $cm^2/v.s$, more preferably more than 50 $cm^2/v.s$.

Preferably, in order to provide a most practical device, the thickness "d" and the electrical conductivity "$\sigma$" of the zinc oxide single crystal satisfy the relation $$\frac{1}{10} \leqq \frac{\sigma \cdot d}{2\pi\epsilon V} \leqq 100$$

where "$\epsilon$" is the dielectric constant of the zinc oxide single crystal and "V" is the velocity of sound in the zinc oxide single crystal.

In another aspect, the invention provides an ultrasonic detection apparatus having a sensing transducer having a zinc oxide single crystal as an acoustoelectric ultrasonic wave sensing element and a pair of electrodes attached to the crystal, and means for detecting acoustoelectric voltage signals induced at said pair of electrodes by ultrasonic waves in said crystal. The detecting means preferably includes a filter for removing from the output signals the frequency corresponding to the frequency of the ultrasonic waves. Thus the filter passes the acoustoelectric signal generated by the waves in the crystal, which signal preferably has a frequency different from that of the ultrasonic waves.

The output impedance of the acoustoelectric element utilized in the present invention varies depending on the electrical conductivity and the size of the zinc oxide single crystal; however it, is usually between several kΩ to several MΩ. On the other hand, the impedance of the cable which connects the ultrasonic wave sensing element and the detector as well as the input impedance of the detector is as large as 50 to 100Ω. Therefore, it is preferable to have a preamplifier which adjusts the impedance of the ultrasonic wave sensing element to that of the cable. Such a preamplifier should preferably be interpositioned between the ultrasonic detecting element and the detector so as to allow the effective detection of the voltage signals transmitted by the ultrasonic detecting element. More preferably, the preamplifier is positioned close to the ultrasonic detecting element.

In yet another aspect, the invention provides ultrasonic measuring apparatus having an ultrasonic transmitter, means for causing the transmitter to emit ultrasonic waves, an ultrasonic sensing transducer having a zinc oxide single crystal as an acoustoelectric element for sensing the ultrasonic waves, and means for detecting electrical signals from the transducer.

When the apparatus is operable in reflection mode, the ultrasonic transmitter and the ultrasonic sensing transducer may be housed together in a unitary housing.

In another aspect, the invention provides a method of converting ultrasonic energy into electrical signals wherein a piezoelectric semiconducting zinc oxide single crystal is employed as a transducer in which acoustoelectric energy conversion occurs without photoconduction.

The invention also provides a method of sensing of ultrasonic waves comprising sensing the waves by means of an ultrasonic transducer having a zinc oxide single crystal as an acoustoelectric element, and monitoring electrical signals emitted by the transducer.

Preferably, the electrical conductivity $\sigma$ of the zinc oxide single crystal satisfies the relation:

$$0.2\pi f\epsilon \leqq \sigma \leqq 20\pi f\epsilon$$

where f is the average ultrasonic wave frequency and "$\epsilon$" is the dielectric constant of the zinc oxide single crystal. Suitably, the thickness "d" satisfies the relation:

$$1\lambda \leqq d \leqq 10\lambda$$

where "$\lambda$" is the average wavelength of the ultrasonic waves in the zinc oxide single crystal.

In practical embodiments of the invention, preferably the c-axis of the zinc oxide single crystal is parallel to the direction of ultrasonic vibration of the ultrasonic waves sensed by the sensing transducer, and the electrodes are arranged opposite each other in the direction of propagation of said sensed ultrasonic waves in the zinc oxide single crystal.

BRIEF INTRODUCTION OF THE DRAWINGS

Embodiments of the present invention will now be described, by way of non-limitative example, with reference to the accompanying drawings, in which.

Figure 8A:
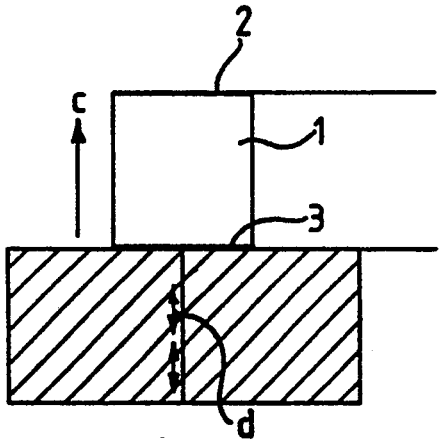
Figure 8B:
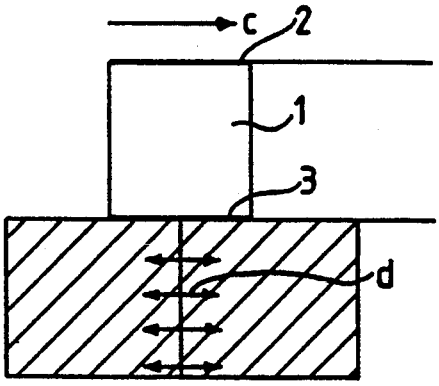
Figure 8C:
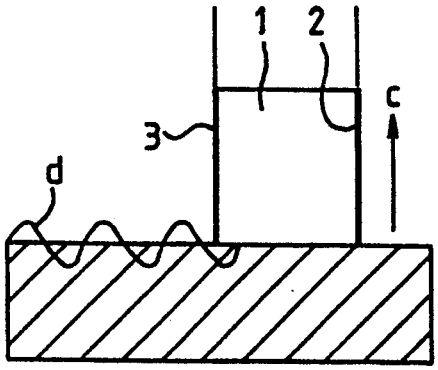

FIGS. 8*a*, 8*b* and 8*c* illustrate diagrammatically different modes of use of a transducer of the invention.

DESCRIPTION OF THE PREFERRED EMBODIMENTS

Figure 1:
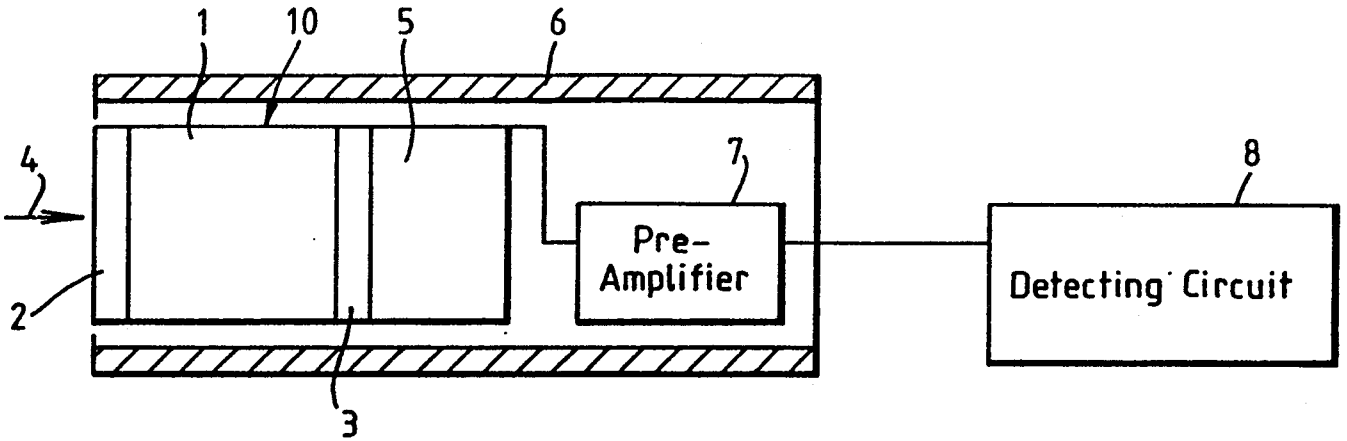
FIG. 1 is a schematic drawing of one form of ultrasonic transducer in accordance with the present invention.

FIG. 1 shows an ultrasonic sensing transducer 10 embodying the present invention and having a zinc oxide single crystal 1 with electrodes 2, 3 on opposite parallel faces. The propagation direction of ultrasonic waves detected by the transducer is perpendicular to the electrodes 2,3 and is indicated by the arrow 4. Behind the electrode 3 remote from the input face for the ultrasonic waves is a backing layer 5, made of epoxy resin, as is conventional in piezoelectric transducers, in order to reduce reflection of the waves at the electrode 3. In this embodiment, the electrodes 2,3 are made of In-Hg amalgam.

The transducer 10 is housed in a housing 6 which also contains a pre-amplifier 7 connected to the electrodes 2,3 and to a detecting circuit 8 outside the transducer housing 6.

In this specific ultrasonic detector of the present invention, the ZnO single crystal is a 4 mm cube which shows piezoelectric semiconducting properties. Its electrical conductivity is $10^{-5}$ 1/Ωcm achieved by doping with lithium ions and control of oxygen vacancies in the zinc oxide crystal structure. The impurity level (other than the dopant lithium) is less than 2 ppm. The charge carrier mobility is 80 $cm^2$/v.s. Methods of making ZnO single crystals of such high purity and suitable conductivity have been described. See for example the articles E. D. Kolb and R. A. Laudise, J. Am. Ceram. Soc. 48, 342 (1964) and N. Sakagami, J. Crystal Growth 99, 905 (1990) and the references mentioned in the latter article. Particularly, the Sakagami reference discloses a hydrothermal method for growing ZnO crystals such as that described above. A seed crystal of ZnO is placed in a top zone inside a hydrothermal autoclave in an electric furnace, and sintered zinc oxide powders are placed in a lower zone inside the autoclave. Then an alkaline aqueous solution containing KOH and LiOH is poured into the autoclave. The furnace is heated to a temperature ranging from 370° to 400° C. under a pressure ranging from 70° to 100 MPa to grow a zinc oxide single crystal, the top zone inside the furnace having a temperature lower by 10°–15° C. than the lower zone inside the furnace.

Assuming that the ultrasonic radiation has a conventional frequency of 10 MHz, the acoustoelectric signal generated in the zinc oxide crystal 1 has a frequency of approximately 0.7 MHz. This means that the detecting circuit can, in a simple manner, include a low-pass filter having a cut-off frequency of 5 MHz in order to remove the frequency corresponding to the frequency of the ultrasonic waves. The pre-amplifier 7 is present in the housing 6, to avoid deterioration of the S/N ratio of the signal before it reaches the detecting circuit 8. For reasons explained below, with a 10 MHz ultrasonic wave frequency, an appropriate minimum thickness of the ZnO crystal in the wave propagation direction is 0.6 mm.

Figure 2:
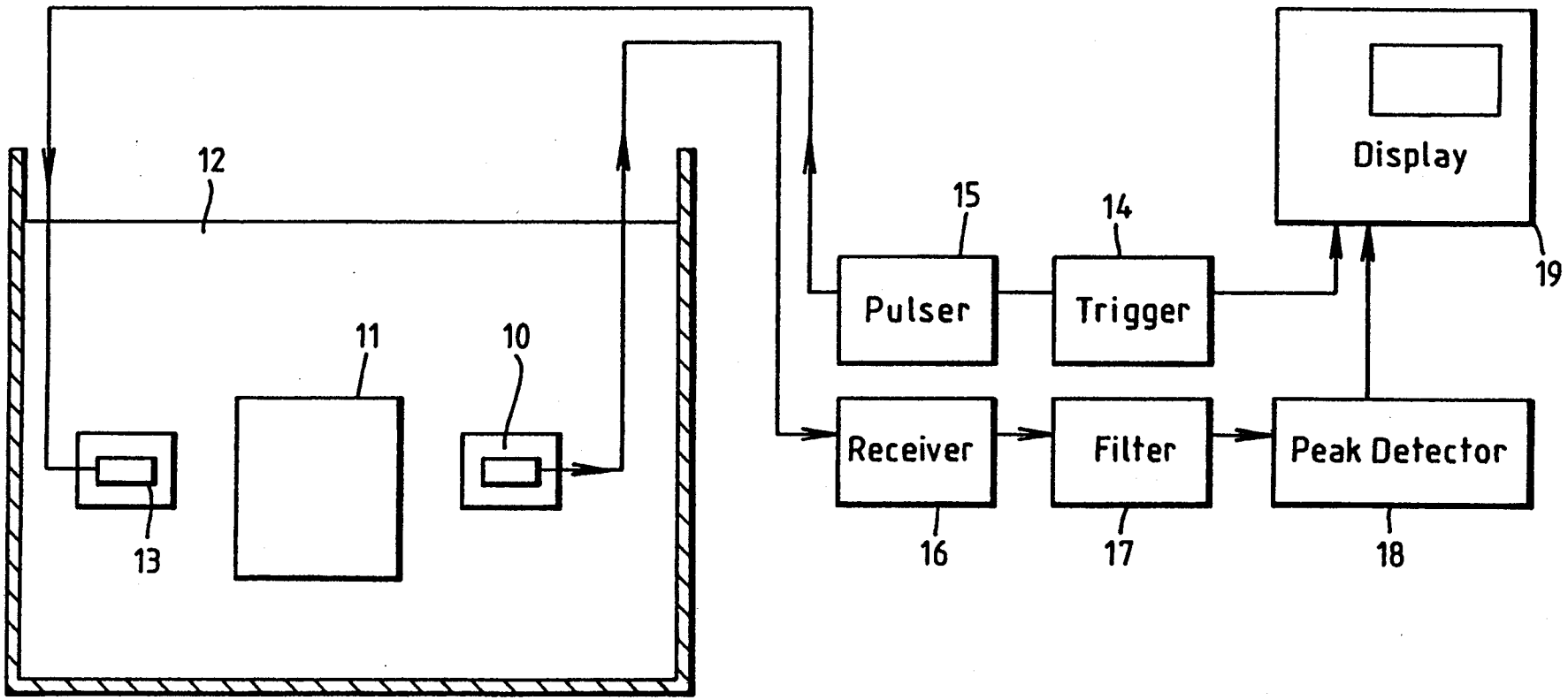
FIG. 2 is a schematic drawing of the ultrasonic detector of FIG. 1 when employed in ultrasonic inspection by the transmission method.

FIG. 2 shows use of the transducer 10 of FIG. 1 as the detector in an apparatus which tests a specimen 11 by the transmission method, using immersion in a liquid medium 12. The apparatus includes an ultrasonic transmitter 13 which may be of conventional type and which is driven by a trigger 14 and pulser 15. The detector 10 is connected to the detecting circuit which in this case comprises a receiver 16, a low-pass filter 17 to remove the frequency of the ultrasonic wave as mentioned above and a peak detector 18. The trigger 14 and the peak detector 18 are connected to an appropriate display device 19. Details of the electrical circuits are conventional and do not require explanation.

Figure 3:
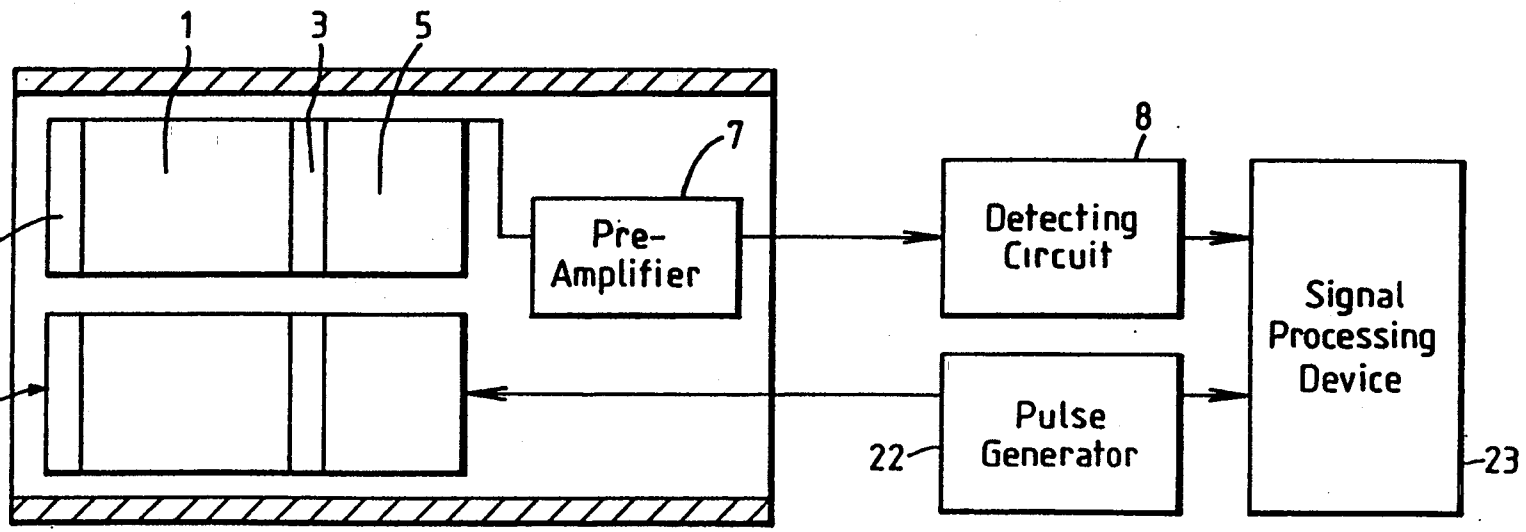
FIG. 3 is a schematic drawing of a second form of ultrasonic transducer of the invention, in which an ultrasonic transmitter and an ultrasonic sensing transducer are combined in a single unit.

FIG. 3 shows an alternative form of ultrasonic testing apparatus according to the present invention, having an ultrasonic transducer comprising a ZnO single crystal 1, electrodes 2,3, backing layer 5 and preamplifier 7 which are the same as in FIG. 1 and a conventional quartz ultrasonic transmitter 20. The transmitter 20 is mounted in the same housing 21 as the zinc oxide single crystal 1 to form a single unit. The detecting circuit 8 for the sensing transducer and a pulse generator 22 for the transmitter 20 are connected to a signal processing device 23.

Figure 4:
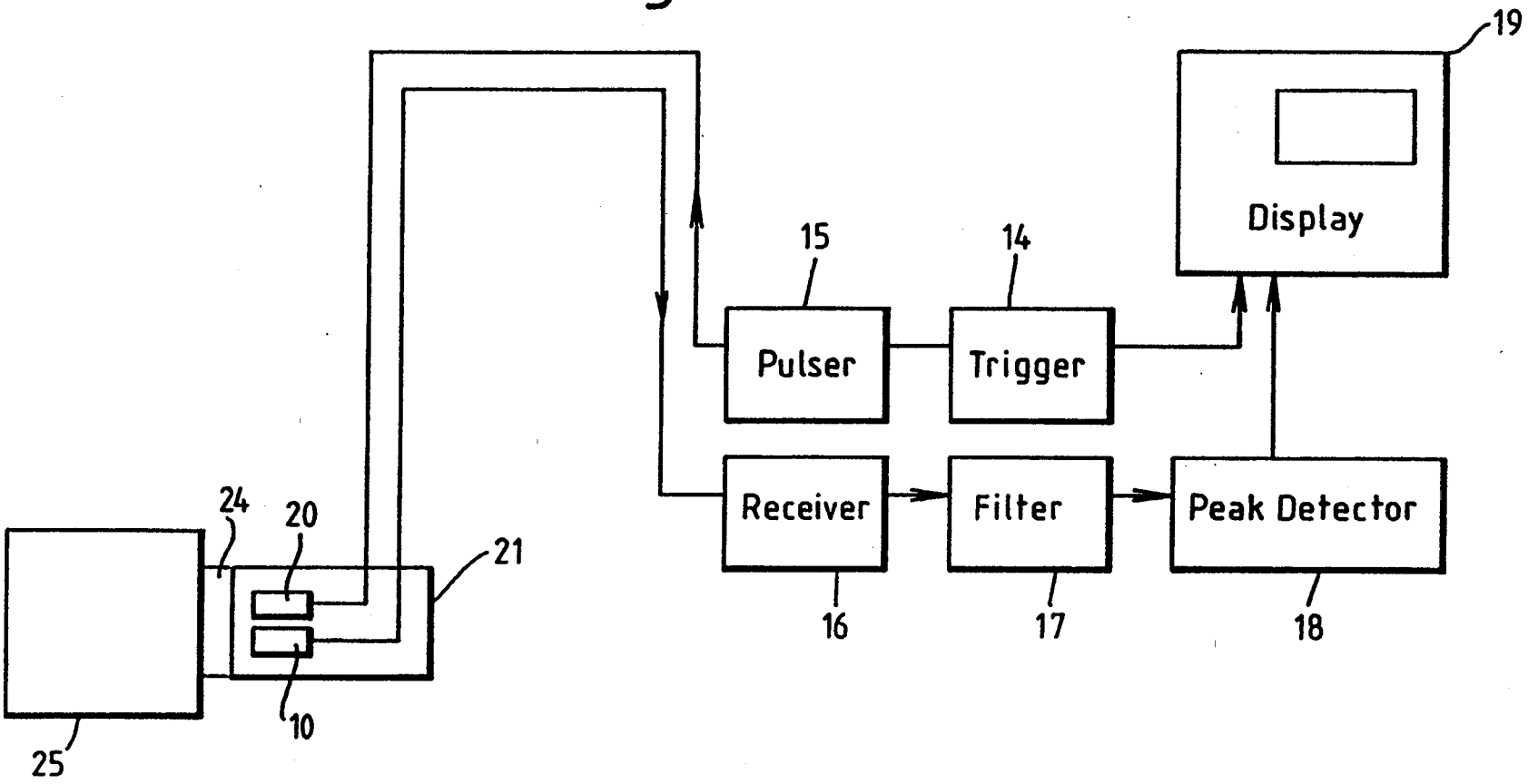
FIG. 4 is a schematic drawing illustrating the use of the transmitter-transducer of FIG. 3 as an ultrasonic sensor, by the pulse echo overlap method.

The ZnO transducer 10 and the quartz transmitter 20 are arranged for ultrasonic investigation of a specimen 25 by the pulse echo overlap method, as illustrated in FIG. 4. A coupling fluid 24 is arranged between the transmitter/transducer 21 and the specimen 25. FIG. 4 shows that the circuit connected to the ZnO transducer 1 includes a filter 17 to remove the ultrasonic wave frequency, as described above.

Figure 5:
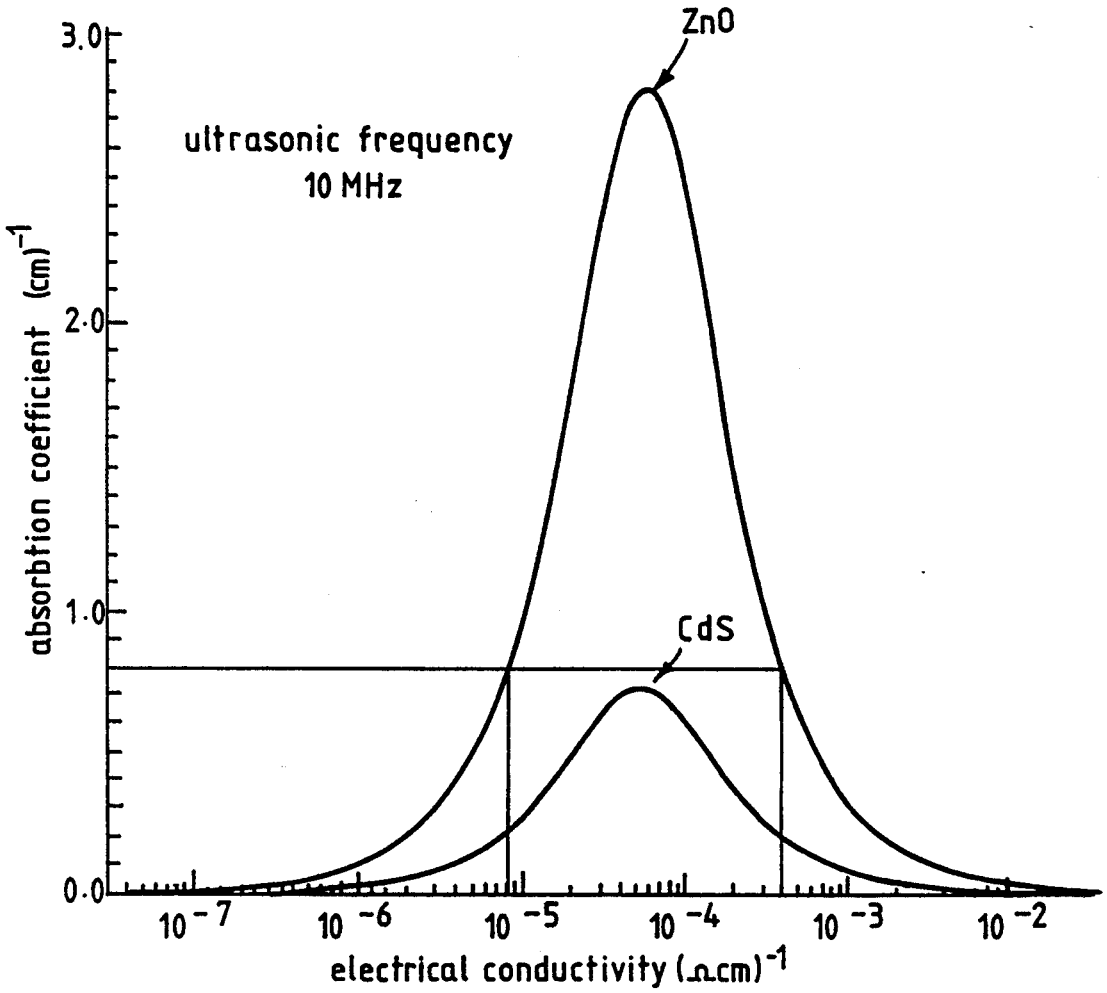
FIG. 5 is a graph plotting the attenuation of ultrasonic waves of 10 MHz against the conductivity of single crystals of ZnO and CdS.

FIG. 5 compares the attenuation of a 10 MHz wave by a ZnO single crystal and a CdS single crystal, over a range of conductivities. The attenuation is a measure of the efficiency of the acoustoelectric energy conversion. It can be seen that the attenuation obtainable in the ZnO crystal is considerably larger than that in the CdS crystal over a wide range of conductivities. The ZnO crystal is therefore a much more sensitive device for ultrasonic sensing. FIG. 5 also shows how, for a given level of attenuation, the conductivity range usable with the zinc oxide crystal is much larger than that with the CdS crystal. Indeed, the maximum attenuation obtainable with CdS is about 0.7 $cm^{-1}$. By contrast, at an attenuation level of 0.8 $cm^{-1}$, the zinc oxide crystal can be employed over a conductivity range of $8\times10^{-6}$ to about $4\times10^{-4}$. Taking into account the effect of the impedance of the amplifier, the preferred conductivity ranges used in the invention are as set out above.

Figure 6:
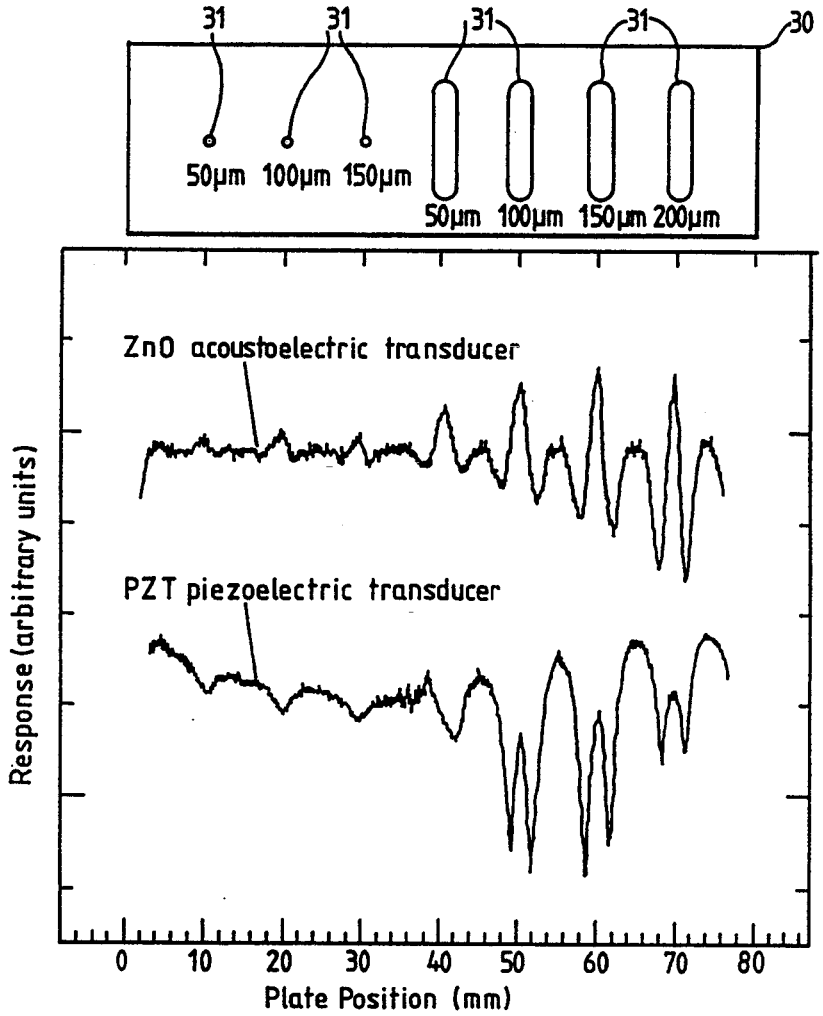
FIG. 6 is a comparison of the ultrasonic signal output of a ZnO acoustoelectric transducer of the present invention and a conventional PZT piezoelectric transducer, for ultrasonic signals transmitted through a sample containing holes and grooves simulating flaws.
Figure 7:
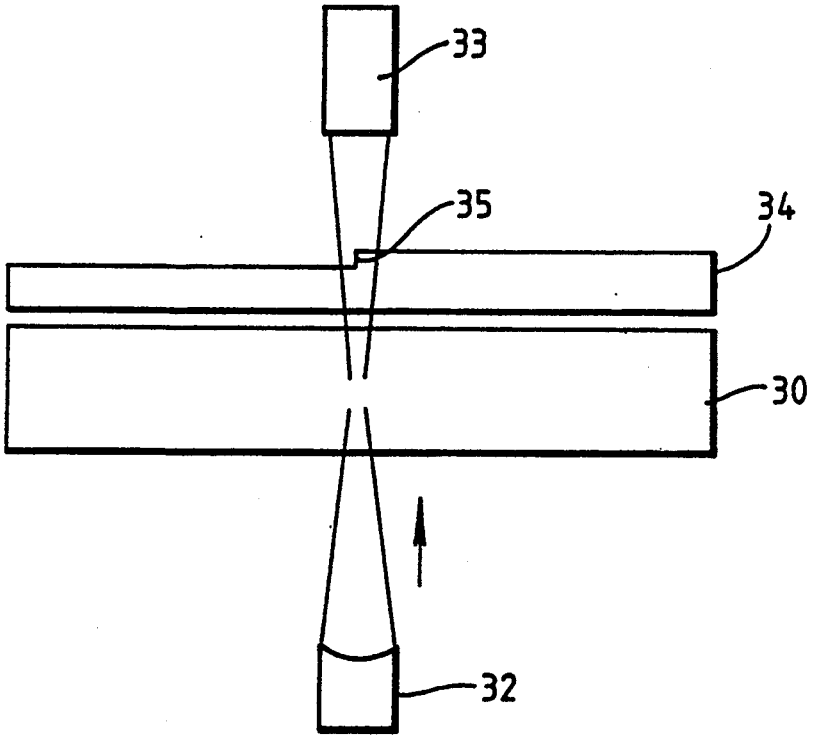
FIG. 7 is a schematic illustration of the test apparatus which provided the graphs of FIG. 6.

FIGS. 6 and 7 illustrate the phase insensitivity of the zinc oxide acoustoelectric transducer of the present invention, compared with the results obtained with a conventional PZT piezoelectric transducer. At the top of FIG. 6 there is illustrated the test specimen 30 which is a plate made of aluminum and containing 3 holes and 4 grooves 31 as artificial flaws. The holes and grooves 31 are flat bottom and differ in depth by about ¼ acoustic wavelength as indicated.

FIG. 7 shows the test specimen 30 of FIG. 6, being scanned by ultrasonic waves emitted by a transmitter 32 and received by the transducer 33 (ZnO or PZT). After transmission through the plate 30 the wave passes through a plate 34 of acrylic plastics material which is moved with the transmitter 32 and transducer 33 so that a step 35 in the thickness of the plate is always located at the region at which the ultrasonic waves passes. This step 35 produces phase modulation of the ultrasonic wave. The response of the transducers is given in FIG. 6, where it can be seen that the ZnO acoustoelectric transducer of the invention produces peaks in accordance with each depth of the holes and grooves 31. In contrast, the output of the PZT piezoelectric transducer does not represent the depths of the holes and grooves 31 due to the phase modulation of the ultrasonic wave, which gives erroneous results.

It is mentioned above that for a practical application of the invention, preferably $$\frac{1}{10} \leqq \frac{\sigma \cdot d}{2\pi\epsilon V} \leqq 100$$

A first consideration is separation of the acoustoelectric and piezoelectric signals which are generated simultaneously in the ZnO crystal by the incident ultrasonic wave. The piezoelectric signal frequency "$f_{PE}$" equals the ultrasonic wave frequency "$f_{US}$." The acoustoelectric signal frequency "$f_{AE}$" is equal to the reciprocal of twice the time of travel of the wave in the crystal $$f_{AE} = V/2d.$$

The requirement for separation of signals that $$f_{AE} \leqq 0.5\ F_{PE}$$

gives $$d \geqq V/f_{US} \quad (I)$$

which is equal to the wavelength "λ" of the wave. For example, when $f_{US}=10$ MHz $V=6100$ m/s $d \geqq 0.61$ mm.

More preferably $d \geqq 2\lambda$ and most preferably $d \geqq 5\lambda$.

A second consideration is the depth resolution achieved in ultrasonic testing of an article. Depth resolution is proportional to the duration of the electric signal generated by one ultrasonic pulse wave in the pulse-echo investigation. The duration of the acoustoelectric signal varies with the duration of the ultrasonic pulse wave, the thickness of the ZnO element, and the reflection coefficient of the interface between the element and the backing layer. The thickness of the ZnO element is preferably less than 10 times the wave length, because the duration of the acoustoelectric signal increases with the thickness $$d \leqq 10\lambda \ (=10\ V/f_{US}) \quad (II)$$

For example, $f_{US}=10$ MHz $V=6100$ m/s $d<10\lambda=6.1$ min.

More preferably $d \leqq 5\lambda$.

A third consideration is the relationship of the ultrasonic frequency and the absorption efficiency and conductivity of the ZnO element. Electrical conductivity at the maximum absorption "$\sigma_M$" is proportional to the ultrasonic frequency. Thus $$\sigma_M = 2\pi\epsilon f_{US}$$

The absorption coefficient "α" decreases in proportion to either the conductivity or the inverse of the conductivity when the conductivity "σ" differs from "$\sigma_M$," as follows $$\text{when } \sigma < \sigma_M,\ \alpha \propto \sigma \quad (i)$$

$$\text{when } \sigma_M < \sigma,\ \alpha \propto \frac{1}{\sigma} \quad (ii)$$

Conductivity can be limited by the condition that the absorption coefficient is not less than 1/10 of its maximum value.

$$1/10 \leqq \sigma/\sigma_M \leqq 10$$

This gives $$1/10 \leqq \frac{\sigma}{2\pi\epsilon f_{US}} \leqq 10 \quad (III)$$

For example:

$F_{US}=10$ MHz $\epsilon_r (=\epsilon/\epsilon_0)=10.02$ where $E_0$ is the dielectric constant of vacuum $\epsilon_0=8.9\times10^{-12}$ F/m $\sigma_M=2\pi\epsilon f_{US}=5.7\times10^{-5}\ (\Omega\ \text{cm})^{-1}$ Thus, $$5.7\times10^{-6}\ (\Omega\ \text{cm})^{-1} \leqq \sigma \leqq 5.7\times10^{-4}\ (\Omega\ \text{cm})^{-1}.$$

By combining conditions I, II and III above, the relationship $$\frac{1}{10} \leqq \frac{\sigma \cdot d}{2\pi\epsilon V} \leqq 100$$

is obtained.

It should be noted that the sound velocity and dielectric constant values given here do not apply to all ZnO crystals, but may vary depending on the ultrasonic vibration mode and the method of crystal production.

In practical embodiments, consideration is also given to the arrangement of the ZnO crystal and the electrodes in relation to the type of ultrasonic wave being employed in a particular ultrasonic investigation. Ultrasonic waves have several vibration forms: longitudinal, shear (transversal), plate and surface waves. Since the piezoelectric effect of the ZnO crystal is strong in the c-axis direction of the crystal, the crystal is preferably arranged so that its c-axis is parallel to the direction of ultrasonic vibration. On the other hand, the acoustoelectric signal is generated in the direction of propagation of the ultrasonic wave in the ZnO crystal. Therefore the electrodes are preferably arranged so that they are opposite each other in the direction of ultrasonic propagation in the crystal. Typically the electrodes are at crystal faces which are parallel to each other and perpendicular to the direction of ultrasonic propagation in the crystal.

Several different modes of ultrasonic investigation of articles are therefore available, as illustrated by FIGS. 8*a*, 8*b* and 8*c*. In these figures, there are shown the ZnO single crystal 1 and electrodes 2,3 of the transducer and a specimen 30 being investigated. A source of ultrasonic waves is not shown. The c-axis direction of the crystal 1 is indicated by arrows "c" and the direction of ultrasonic vibration by arrows "d"]and wave "d." In FIG. 8*a* and FIG. 8*b* the direction of propagation of the ultrasonic wave is vertical, and in FIG. 8*c* is horizontal.

FIG. 8*a* shows an investigation using a longitudinal ultrasonic wave, which is typical of a general investigation, e.g. of flaws or defects inside a metal article. The c-axis is perpendicular to the incident plane of the wave on the crystal 1, while the electrodes 2,3 are parallel to this incident plane. This is the most preferred mode of operation.

In FIG. 8*b* a shear wave, such as is used for angle beam investigation of welds, is shown. The crystal c-axis and the electrodes are parallel to the incident plane of the wave on the crystal.

FIG. 8*c* illustrates the cases of a plate wave and a surface wave. A plate wave may be used for measurements of plate thickness, or investigation of thin plate. A surface wave can be used for investigation of the cleanness of surfaces. In both cases, the c-axis is perpendicular to the incident plane of the wave at the crystal, and the electrodes are perpendicular to both the incident plane and the propagation direction.

However the devices of the invention can operate when the crystal c-axis and the electrodes are not exactly perpendicular or parallel to the ultrasonic vibration and propagation directions.

While the invention has been illustrated here by various embodiments, it is not limited thereto, and other embodiments, variations and modifications are possible within the scope of the invention.

What is claimed is:

1. An acoustoelectric ultrasonic wave sensing element comprising a zinc oxide single crystal in which ultrasonic waves are transduced into electric voltage accompanied by phonon-charge carrier interaction.

2. An ultrasonic transducer comprising a zinc oxide single crystal having a pair of opposite faces to which a pair of electrodes are attached, wherein a thickness d between said opposite faces and an electrical conductivity $\sigma$ of said crystal satisfy the following:

$$10^{-8}\ (\Omega\text{cm})^{-1}21\ \sigma < 10^{-2}\ (\Omega\text{cm})^{-1}$$

and $$\frac{1}{10} \leqq \frac{\sigma \cdot d}{2\pi\epsilon v} \leqq 100$$

$\epsilon$ being the dielectric constant of said zinc oxide single crystal and v being the velocity of sound in said zinc oxide single crystal.

3. The ultrasonic transducer of claim 2, wherein said thickness of said zinc oxide single crystal is in a range of $$120\ \mu\text{m} < d < 120\ \text{cm}.$$

4. The ultrasonic transducer of claim 2, wherein the electrical conductivity of said zinc oxide single crystal is in a range of $10^{-7}$ to $10^{-4}\ \Omega^{-1}\ \text{cm}^{-1}$.

5. The ultrasonic transducer of claim 2, wherein said single crystal has an attenuation rate for ultrasonic waves of 10 MHz of at least 0.8 $\text{cm}^{-1}$.

6. The ultrasonic transducer of claim 2, wherein said zinc oxide single crystal contains at least one acceptor element and not more than 2 ppm non-acceptor impurity elements.

7. The ultrasonic transducer of claim 2, wherein said zinc oxide single crystal contains at least one donor element and not more than 2 ppm non-donor impurity elements.

8. The ultrasonic transducer of claim 2, wherein said zinc oxide single crystal has a charge carrier mobility greater than 8 $\text{cm}^2$/volt-second.

9. An ultrasonic detection apparatus having an acoustoelectric ultrasonic sensing transducer comprising a zinc oxide single crystal having a pair of opposite faces to which a pair of electrodes are attached, and means for detecting electrical signals induced at said pair of electrodes by ultrasonic waves in said crystal, wherein said electrical signals include signals into which said ultrasonic waves are transduced accompanied by phonon-charge carrier interaction.

10. The ultrasonic detection apparatus of claim 9, wherein the c-axis of said zinc oxide single crystal is parallel to the direction of ultrasonic vibration of the ultrasonic waves sensed by said sensing transducer, and said electrodes are arranged opposite each other in the direction of propagation of said sensed ultrasonic waves in said zinc oxide single crystal.

11. The ultrasonic detection apparatus of claim 9, wherein said detecting means includes a wave filter for removing from said signals frequency signals corresponding to the frequency of said ultrasonic waves.

12. An ultrasonic measuring apparatus having an ultrasonic transmitter, means for causing said transmitter to emit ultrasonic waves, an acoustoelectric ultrasonic sensing transducer comprising a zinc oxide single crystal having a pair of opposite faces to which a pair of electrodes are attached, and means for detecting electrical signals induced at said pair of electrodes by ultrasonic waves in said crystal, wherein said electrical signals include signals into which said ultrasonic waves are transduced accompanied by phonon-charge carrier interaction.

13. An ultrasonic measuring apparatus of claim 12 operable in reflection mode, wherein said ultrasonic transmitter and said ultrasonic sensing transducer are housed together in a unitary housing.

14. An ultrasonic measuring apparatus of claim 12, wherein said wave emitted by said ultrasonic transmitter have a predetermined frequency and said detecting means includes a wave filter to remove from said signals a frequency corresponding to said predetermined frequency.

15. An ultrasonic measuring apparatus of claim 12, wherein the c-axis of said zinc oxide single crystal is parallel to the direction of ultrasonic vibration of the ultrasonic waves sensed by said sensing transducer, and said electrodes are arranged opposite each other in the direction of propagation of said sensing ultrasonic waves in said zinc oxide single crystal.

16. A method of converting ultrasonic energy into electrical signals wherein a piezoelectric semiconducting zinc oxide single crystal is employed as a transducer in which acoustoelectric energy conversion occurs without photoconduction.

17. A method of detection of ultrasonic waves comprising:

sensing said waves by means of an ultrasonic sensing transducer comprising a zinc oxide single crystal having a pair of opposite faces to which a pair of electrodes are attached, wherein a thickness d between said opposite faces and an electrical conductivity $\sigma$ of said crystal satisfy the following:

$$10^{-8}\ (\Omega\text{cm})^{-1} < \sigma < 10^{-2}\ (10^6\ \text{cm})^{-1}$$

and $$\frac{1}{10} \leqq \frac{\sigma \cdot d}{2\pi\epsilon V} \leqq 100$$

$\epsilon$being the dielectric constant of the zinc oxide single crystal and v being the velocity of sound in the zinc oxide single crystal; and monitoring electrical signals generated between said pair of electrodes.

18. The method of claim 17, wherein the electrical conductivity $\sigma$ of zinc oxide single crystal satisfies the following:

$$0.2\pi f\epsilon \leqq \sigma \leqq 20\pi f\epsilon$$

f being the average ultrasonic wave frequency and $\epsilon$ being the dielectric constant of the zinc oxide single crystal.

19. The method of claim 17, wherein said thickness d satisfies the following:

$$1\lambda \leqq d \leqq 10\lambda$$

$\lambda$ being the average wavelength of the ultrasonic waves in said zinc oxide single crystal.

20. The method of claim 17, wherein the c-axis of said zinc oxide single crystal is parallel to the direction of ultrasonic vibration of the ultrasonic waves sensed by said sensing transducer, and said electrodes are arranged opposite each other in the direction of propagation of said sensed ultrasonic waves in said zinc oxide single crystal.

* * * * *